US010578297B1

(12) United States Patent
Zhu et al.

(10) Patent No.: US 10,578,297 B1
(45) Date of Patent: Mar. 3, 2020

(54) MULTI-FUNCTION FLASHLIGHT

(71) Applicant: SMARTECH INC., Savage, MD (US)

(72) Inventors: Shiqi Zhu, Savage, MD (US); Tao Li, Savage, MD (US)

(73) Assignee: SMARTECH, INC., Savage, MD (US)

( * ) Notice: Subject to any disclaimer, the term of this patent is extended or adjusted under 35 U.S.C. 154(b) by 0 days.

(21) Appl. No.: 16/447,410

(22) Filed: Jun. 20, 2019

(51) Int. Cl.

| | |
|---|---|
| ***F21V 31/00*** | (2006.01) |
| ***F21L 4/02*** | (2006.01) |
| ***F21L 4/04*** | (2006.01) |
| ***F21L 4/08*** | (2006.01) |
| ***F21V 23/02*** | (2006.01) |
| ***F21V 33/00*** | (2006.01) |
| ***F21V 29/508*** | (2015.01) |
| ***F21V 29/76*** | (2015.01) |
| ***F21V 9/08*** | (2018.01) |
| ***F21V 23/06*** | (2006.01) |
| ***F21Y 115/10*** | (2016.01) |

(52) U.S. Cl.

CPC ..... *F21V 31/005* (2013.01); *F21L 4/027* (2013.01); *F21L 4/045* (2013.01); *F21L 4/08* (2013.01); *F21V 9/083* (2013.01); *F21V 23/023* (2013.01); *F21V 23/06* (2013.01); *F21V 29/508* (2015.01); *F21V 29/767* (2015.01); *F21V 33/0076* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 7,140,748 | B2 * | 11/2006 | Chien | F21L 4/027 362/205 |
| 2006/0146526 | A1 * | 7/2006 | Shiau | F21L 4/027 362/205 |
| 2012/0314403 | A1 * | 12/2012 | Kennedy | F21V 9/083 362/109 |
| 2015/0003050 | A1 * | 1/2015 | Parsons | F21L 4/005 362/158 |
| 2017/0299130 | A1 | 10/2017 | Li et al. | |
| 2018/0231215 | A1 | 8/2018 | Bian | |
| 2019/0268518 | A1 * | 8/2019 | Howard | H04N 5/2256 |

FOREIGN PATENT DOCUMENTS

| | | |
|---|---|---|
| CN | 2577099 Y | 10/2003 |
| CN | 202132720 U | 2/2012 |

* cited by examiner

*Primary Examiner* — Britt D Hanley

(74) *Attorney, Agent, or Firm* — Welsh Flazman & Gitler LLC

(57) ABSTRACT

A high lumen output flashlight includes a flashlight head at a first end of the flashlight and a power assembly at a second end of the flashlight. The power assembly includes power management module body member with a pivotally mounted cover selectively covering a recess formed in a second end of the power management module body member. An O-ring is positioned between the pivotally mounted cover and the power management module body member in a manner providing waterproof or water resistant protection. A central body member is positioned between the flashlight head and the power assembly. The flashlight head includes an outer body member secured to a first end of the central body member and an LED light assembly is positioned within the outer body member. The outer body member includes a plastic heat insulating ring.

17 Claims, 4 Drawing Sheets

MULTI-FUNCTION FLASHLIGHT

BACKGROUND OF THE INVENTION

1. Field of the Invention

The present invention relates to multi-function flashlights.

2. Description of the Related Art

Flashlights have been available for years. They provide handheld convenience in a wide variety of environments. Flashlights are especially useful in emergency situations. In addition to the need for a light source when confronted with an emergency situation, people are confronted with a variety of issues when dealing with an emergency. The present invention addresses this problem by providing a flashlight a variety of functionalities well suited for an emergency environment.

SUMMARY OF THE INVENTION

It is, therefore, an object of the present invention to provide a flashlight including flashlight head at a first end of the flashlight having a waterproof cavity retaining a LED light assembly. The flashlight also includes a power assembly having a power management module body member with a pivotally mounted cover selectively covering a recess formed in a second end of the power management module body member. At least one of a USB outlet port, a charging input port, a jump start cable outlet port, and LED charging indicator lights are located within the recess. An O-ring is positioned between the cover and the power management module body member in a manner providing waterproof protection for the at least one of the USB outlet port, the charging input port, the jump start cable outlet port, and the LED charging indicator lights when the cover is closed. A central body member is connected between the flashlight head and the power assembly to form a waterproof cavity retaining at least one rechargeable battery.

It is also an object of the present invention to provide a flashlight wherein the pivotally mounted cover uses magnets positioned on the power management module body member for securing the cover in a closed and sealed orientation.

It is another object of the present invention to provide a flashlight wherein the cover includes an exterior surface having a magnet attached along the exterior surface of the cover.

It is a further object of the present invention to provide a flashlight wherein the strength of the magnet on the exterior surface of the cover is less than that of the magnets respectively positioned on the power management module body member.

It is also an object of the present invention to provide a flashlight wherein the flashlight head includes a crenelated strike bezel adapted to break a car window.

It is another object of the present invention to provide a flashlight wherein the flashlight head includes an outer body member secured to a first end of the central body member and the LED light assembly is positioned within the outer body member.

It is a further object of the present invention to provide a flashlight wherein the outer body member is of a three piece construction and includes a front body member part separated from contact with a back body member part by a plastic heat insulating ring.

It is also an object of the present invention to provide a flashlight wherein the front body member part of the outer body member includes heat transfer fins that function to dissipate heat from the outer body member.

It is another object of the present invention to provide a flashlight wherein the plastic heat insulating ring is a complete ring having a radial flange and first external threads on a first side of the radial flange and second external threads on a second opposite side of the radial flange. The first external threads are secured to the front body member part and the second external threads are secured to the back body member part so as form the outer body member.

It is a further object of the present invention to provide a flashlight including externally threaded colored lenses for selective attachment thereto.

It is also an object of the present invention to provide a flashlight wherein the power assembly also includes a power management module including at least one circuit board.

It is another object of the present invention to provide a flashlight wherein the power management module includes a USB outlet port, a charging input port, a jump start cable outlet port, and LED charging indicator lights.

It is a further object of the present invention to provide a flashlight including a flashlight head at a first end of the flashlight, a power assembly at a second end of the flashlight, and a central body member positioned between the flashlight head and the power assembly. The flashlight head includes an outer body member secured to a first end of the central body member and an LED light assembly is positioned within the outer body member. The outer body member includes a plastic heat insulating ring limiting the flow of heat from the flashlight head to the central body member.

It is also an object of the present invention to provide a high lumen output flashlight including a flashlight head at a first end of the flashlight and a power assembly at a second end of the flashlight. The power assembly includes a power management module body member with a pivotally mounted cover selectively covering a recess formed in a second end of the power management module body member. A USB outlet port, a charging input port, a jump start cable outlet port, and LED charging indicator lights are within the recess. An O-ring is positioned between the pivotally mounted cover and the power management module body member in a manner providing waterproof or water resistant protection for the USB outlet port, the charging input port, the jump start cable outlet port, and the LED charging indicator lights when the pivotally mounted cover is closed. The pivotally mounted cover uses magnets for securing the cover in a closed orientation. A central body member is positioned between the flashlight head and the power assembly. The flashlight head includes an outer body member secured to a first end of the central body member and an LED light assembly is positioned within the outer body member. The outer body member includes a plastic heat insulating ring positioned between the central body member and the outer body member, wherein the plastic heat insulating ring is a complete ring having a radial flange and first external threads on a first side of the radial flange and second external threads on a second opposite side of the radial flange. The first external threads are secured to the front body member part and the second external threads are secured to the back body member part so as form the outer body member.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figures 1, 2:
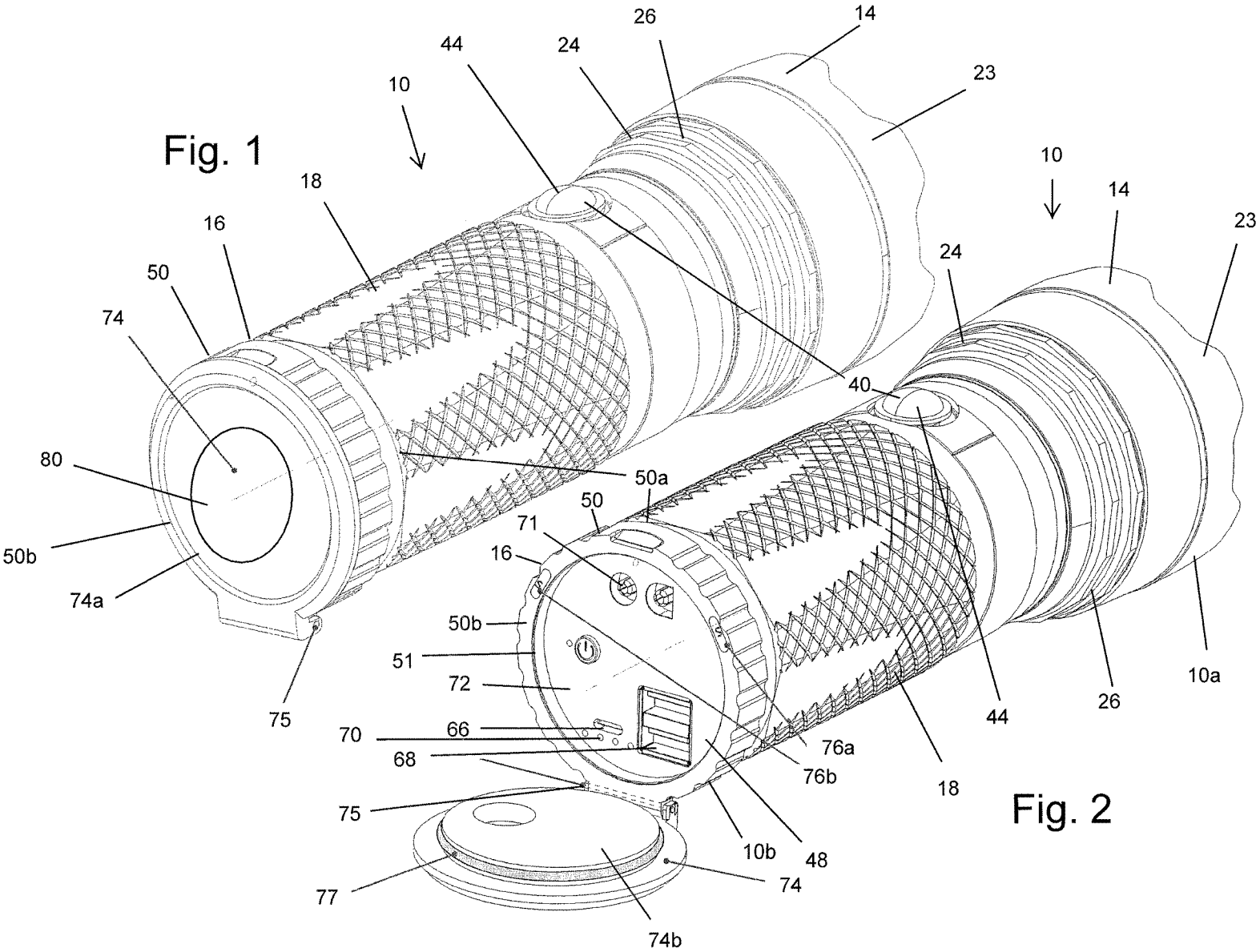
FIG. 1 is a rear perspective view of the flashlight with the cover closed.
FIG. 2 is a rear perspective view of the flashlight with the cover open and the charging input port, the USB outlet port, the jump start cable outlet port, and the LED charging indicator lights exposed.
Figure 3:
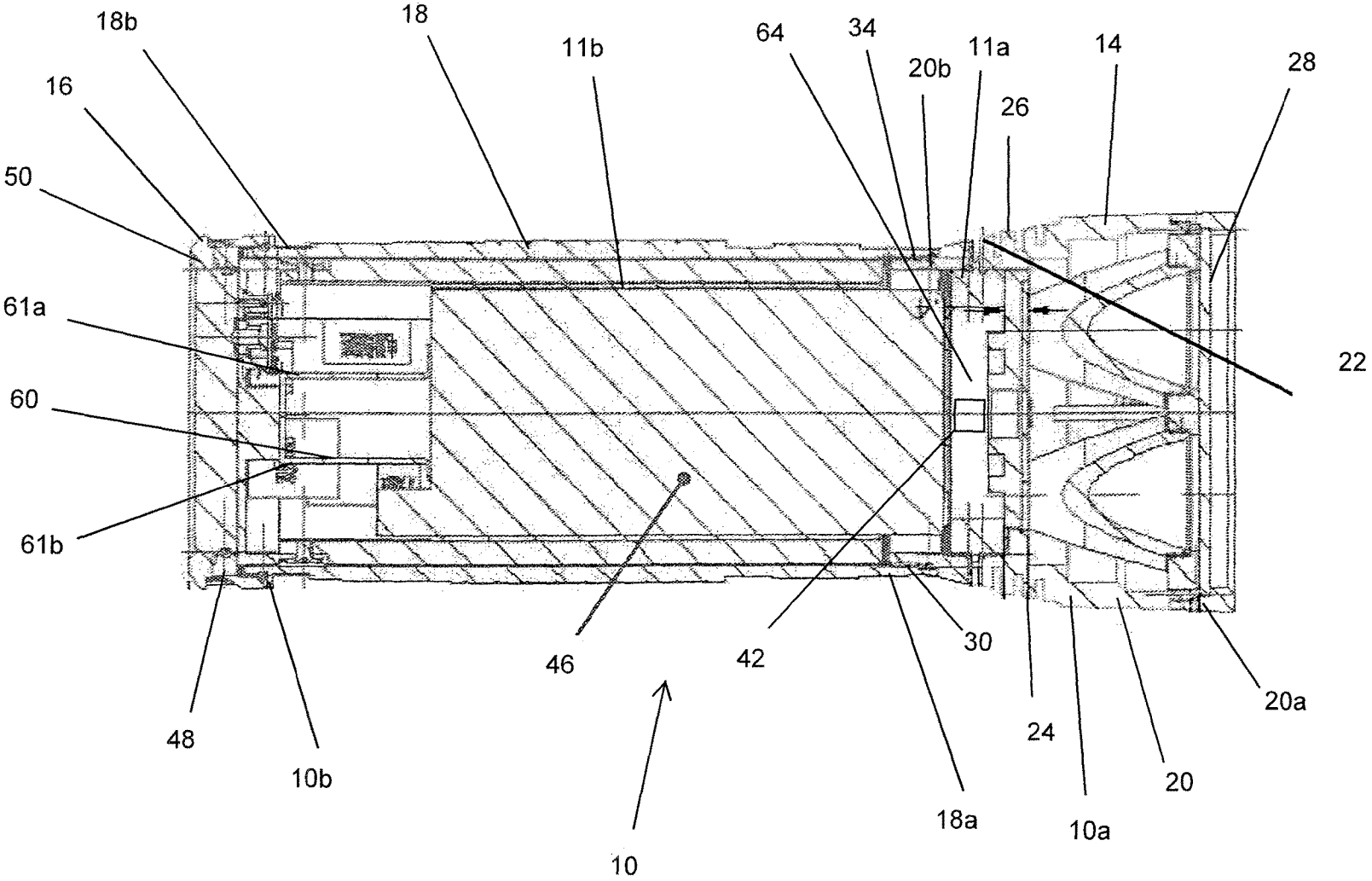
FIG. 3 is a cross sectional view of the flashlight shown in FIG. 1.
Figure 4:
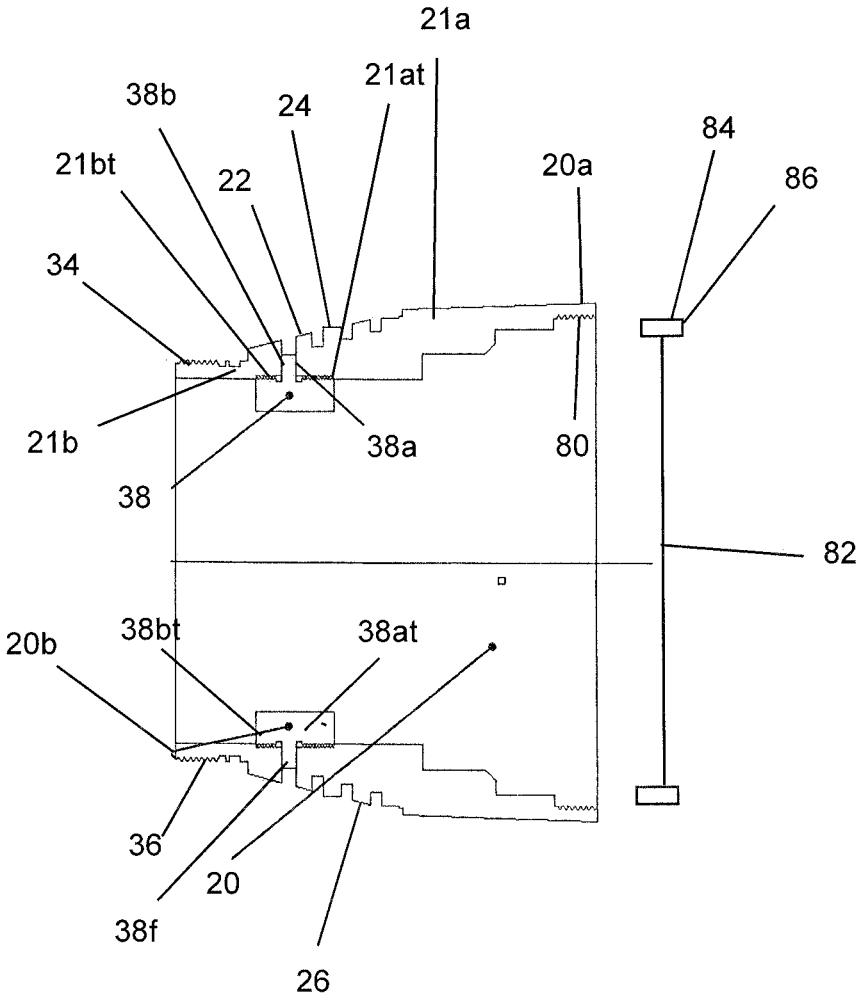
FIG. 4 is a detailed cross sectional view of the outer body member of the flashlight head.
Figure 5:
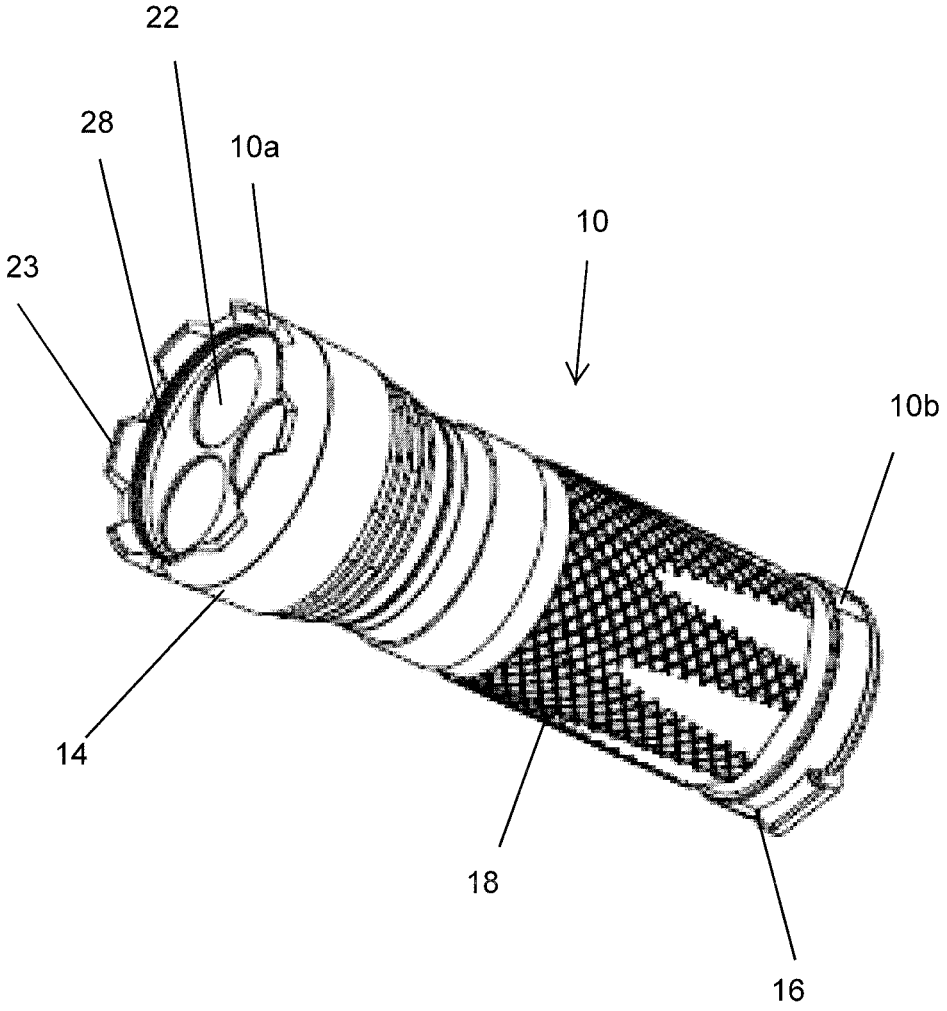
FIG. 5 is a front perspective view of the flashlight.

With reference to FIGS. 1 to 5, a multi-function flashlight 10 is disclosed. The flashlight 10 offers high lumen output with a rechargeable lithium-ion battery (through USB-C quick charging) integrated with a power assembly 16 and jump starting functionality. As used herein, high lumen output is meant to encompass flashlights offering at least 2,000 lumens of output, although should be understood the flashlight of the present invention has a top lumen output of 8,000 lumens.

The flashlight 10 includes an elongated cylindrical construction having a first end 10*a* and a second end 10*b*. The first end 10*a* includes a flashlight head 14, the second end 10*b* includes power assembly 16, and a hollow, cylindrical central body member 18 is positioned therebetween. The power assembly 16 is meant to broadly refer to those elements of the present invention responsible for the supply of power in the flashlight 10. As such, and as will be appreciated based upon the following disclosure, the power assembly 16 is thought of as including the at least one rechargeable lithium ion battery 46 and the power management module 48 (and its associated elements).

The first end 10*a*, that is the flashlight head 14, is provided with a tactical design build allowing a user to break a vehicle window in case of an emergency. In particular, the outer body member 20 of the flashlight head 14 is provided with a crenelated strike bezel 23. The crenelated strike bezel 23 will easily break a car window when the crenelated strike bezel 23 of the flashlight head 14 strikes a car window with force. The crenelated strike bezel 23 of the flashlight head 14 may also be used for self-defense purposes. As will be appreciated based upon the following disclosure, the super strong strobe light mode can also help in providing self-defense in emergency situations as the flashing light at a high lumen is highly annoying to the eyes of an attacker.

The first end 10*a* of the flashlight 10 is generally composed of the flashlight head 14. The flashlight head 14 includes an outer body member 20 that is secured to the first end 18*a* of the cylindrical central body member 18. The outer body member 20 flares outwardly as it extends toward the first end 10*a* of the flashlight. An LED light assembly 22 is positioned within the outer body member 20. The outer body member 20 includes an outer surface 24 with heat transfer fins 26 that function to dissipate heat generated through usage of the flashlight 10. The outer body member 20 also includes a first end 20*a* and a second end 20*b*. The second end 20*b* of the outer body member 20 is positioned over the first end 18*a* of the cylindrical central body member 18 and is secured thereto. A transparent lens 28 is secured at the first end 20*a* of the outer body member 20 in a watertight manner, preferably with the use of a waterproof adhesive.

Further still, the first end 20*a* of the outer body member 20 is provided with internal threading 80 that allows for selective attachment of colored lenses 82 via external threading 84 provided on the rim 86 of the colored lenses 82. Such colored lenses allow the flashlight to shine red, blue, or green. The use of such lenses is of great value to campers, hikers, and hunters. For example, many animals are color blind and, therefore, will not be able to identify the light coming from the flashlight when the colored lenses are used. In addition, various type of animal feces are readily identified under colored light, allowing campers, hikers and/or hunters to identify nearby animals when moving through the woods at night.

The second end 20*b* of the outer body member 20 is secured to the first end 18*a* of the cylindrical central body member 18 via a threaded arrangement. In particular, threads 30 formed on the inner wall 32 at the first end 18*a* of the cylindrical central body member 18 selectively engage threads 34 formed on the outer wall 36 at the second end 20*b* of the outer body member 20. When the outer body member 20 is secured to the cylindrical central body member 18, the flashlight head 14 and the cylindrical central body member 18 form a cavity 11*a*. Upon complete assembly of the flashlight 10, the cavity 11*a* is waterproof and prevents damage to the LED light assembly 22 should the flashlight 10 be submerged in water for a period of time. In accordance with a preferred embodiment, permanent adhesive is used to permanently secure the outer body member 20 to the cylindrical central body member 18 forming a waterproof seal between the flashlight head 14 and the cylindrical central body member 18.

In order to thermally isolate the cylindrical central body member 18 from the heat generated by the LED light assembly 22 in the flashlight head 14, the outer body member 20 is constructed so as to insulate the cylindrical body member 18 from the heat generated by the LED light assembly 22. In particular, the outer body member 20 is constructed with a three-piece assembly composed of a plastic heat insulating ring 38, a front body member part 21*a*, and a back body member part 21*b* (which defines the second end 20*b* of the outer body member 20 and is, therefore, directly in contact with the cylindrical central body member 18). The plastic heat insulating ring 38 is a complete ring having externally threaded sections 38*at*, 38*bt* extending axially from both its first end 38*a* and its second end 38*b*. The externally threaded sections 38*at*, 38*bt* at the first and second ends 38*a*, 38*b* of the plastic heat insulating ring 38 are respectively secured to the front body member part 21*a* and the back body member part 21*b* (both of which include internal threads 21*at*, 21*bt* at the junction point) so as form the complete outer body member 20. The threading of the heating insulating ring 38, the front body member part 21*a*, and the back body member part 21*b* are constructed such that when the parts are fully assembled a space exists between the front body member part 21*a* and the back body member part 21*b*, and there is no direct contact between the two.

The insulating effects of the heat insulating ring 38 are further enhanced by the provision of a radially, outwardly extending flange 38*f* between the externally threaded sections 38*at*, 38*bt* at the first and second ends 38*a*, 38*b* of the plastic heat insulating ring 38. The radially extending flange 38*f* sits between the front body member part 21*a* and the back body member part 21*b*. In addition to ensuring the front body member part 21*a* and the back body member part 21*b* do not contact each other, the radially, outwardly extending flange defines an insulating surface between the front body member part 21*a* and the back body member part 21*b*. Adhesive is ultimately used to permanents secure these components of the outer body member 20 together.

The primary heat generating portion of the LED light assembly 22, that is, the LED lights, is positioned within the front body member 21*a*. As a result, the inclusion of the plastic heat insulating ring 38 between the front body member part 21*a* and the back body member part 21*b* of the outer body member 20 of the flashlight head 14 prevents heat conduction from the front body member part 21*a* to the back body member part 21*b*, and ultimately to the cylindrical central body member 18 (due to the fact the back body member part 21*b* defines the second end 20*b* of the outer body member 20 and is directly in contact with the cylindrical central body member 18). This provides for comfortable usage while holding the flashlight 10. Further protection from heat is provided through the provision of temperature control technology to automatically adjust the lumen level based on temperature of the cylindrical central body member 18. The temperature control technology includes a circuit 90 integrated into the circuit board 64 (discussed below) of the LED light assembly 22. The circuit 90 includes a temperature sensor 92 which will reduce the power being supplied to the LED light assembly 22 when it determines the flashlight 10 has become too hot to hold. In particular, when the temperature reaches a certain point (for example, 70 degrees Celsius) the circuit 90 reduces the power output automatically to the point the circuit board temperature is not over 70 degrees Celsius.

An on/off control button 40 is provided on the exterior of the cylindrical central body member 18 adjacent to the junction of the cylindrical central body member 18 and outer body member 20. The on/off control button 40 functions to interact with an actuator 42 of the LED light assembly 22 to control the flow of electricity between the battery 46 and the LED light assembly 22. The control button 40 and actuator 42 are linked to a control circuit 64 of the LED light assembly that allows for great flexibility in the light mode used by the flashlight 10; for example, turbo light mode (8,000 lumens output), high light mode (3,000 lumens output), medium light mode (1,500 lumens output), low light mode (100 lumens output), strobe light mode (continuous flashing at 8,000 lumens), SOS light mode (three short flashes, three long flashes, three short flashes). In addition, a multicolor display 44 is integrated into the control button 40 and provides an indication of the battery power (for example, green indicates high battery power, yellow indicates medium battery power, and red indicates low battery power).

The hollow cylindrical central body member 18 defines a cavity 11*b* into which at least one rechargeable battery 46 is selectively positioned. In accordance with the present flashlight 10, and in order to provide the functionality offered by the present flashlight 10, the battery 46 is an 8,000 mAh (milliampere hour) battery. The power assembly 16 is secured at the second end 18*b* of the cylindrical central body member 18 of the flashlight 10. The power assembly 16 may be thought of as including the at least one rechargeable lithium ion battery 46. In accordance with a preferred embodiment of the flashlight 10, the power assembly 16 includes 3 lithium ion batteries that are positioned within the cylindrical central body member 18 for a watertight assembly. The power assembly 16 also includes a power management module 48 for controlling various elements of the electrical power as will be described below in greater detail.

The power management module 48 includes a power management module body member 50 that is adapted for selective attachment to the second end 18*b* of the cylindrical central body member 18. Selective attachment of the cylindrical central body member 18 and the power management module body member 50 is achieved via a watertight threaded relationship wherein threads 52 formed on the inner wall 54 at the first end 50*a* of the power management module body member 50 selectively engage threads 56 formed on the outer wall 58 at the second end 18*b* of the cylindrical central body member 18. When the power management module body member 50 is secured to the cylindrical central body member 18, the cavity 11*b* formed by the hollow cylindrical central body member 18 is closed in a watertight manner at the second end 10*b* of the flashlight 10 to retain the at least one battery 46 in the watertight environment of the cavity 11*b* and the cavity 11*b* extends to and communicates with cavity 11*a* in which the LED light assembly 22 is retained.

The circuit board assembly 60 includes first and second circuit boards 61*a*, 61*b* mounted within the first end 50*a* of the cylindrical power management module body member 50 and has wiring (not shown) extending therefrom for contact with the LED light assembly 22, in particular, a circuit board 64 of the LED light assembly 22, which as explained below controls various functionalities, of the flashlight 10. Wiring extending from the first and second circuit boards 61*a*, 61*b* is also coupled to the on/off control button 40. Further, the first and second circuit boards 61*a*, 61*b* are secured to the battery 46 in a conventional manner. In this way, a complete circuit is generated amongst the power management module 48, the on/off control button 40, the electrical circuit board 64 of the LED light assembly 22, the first and second circuit boards 61*a*, 61*b* of the circuit board assembly 60, and the at least one battery 46.

Further functionality of the present flashlight 10 is achieved by the provision of a charging input port 66, a USB outlet port 68, a jump start cable outlet port 71, and LED charging indicator lights 70 in the power management module 48. In particular, the USB outlet port 68, jump start cable outlet port 71, and LED charging indicator lights 70 are formed in a recess 72 formed along the second end 50*b* of the cylindrical power management module body member 50. The USB outlet port 68, the jump start cable outlet port 71, and the LED charging indicator lights 70 are electrical connected to the battery 46 using known circuitry. Further, the control of the USB outlet port 68, the jump start cable outlet port 71, and the LED charging indicator lights 70 is achieved using known circuitry that is incorporated into the power management module 48. As those skilled in the art will appreciate, the LED charging indicator lights 70 show charging/power status while the device is charging, or with one easy touch button on the back of the flashlight 10 so the operator is always aware of the power level.

In addition, the jump start cable outlet port 71 connects to a smart jump clamp (not shown). The jump start cable outlet port 71 is provided with short circuit, reverse polarity, spark proof, low voltage protection, and reverse charge protection technology that are integrated into the first printed circuit board 61*a*. The spark proof protection ensures that the smart jump starter connector is spark proof and there is no spark when the clip is attached to the battery. The reverse polarity protection ensures that when the clamp is connected to the wrong battery post, the clamp and power assembly 16 will not be damaged. Further, the short circuit protection ensures that in the event the to jumpstart clips are connected to each other, the clip and power assembly 16 will not be damaged. Low voltage protection functions to automatically stop operation when the internal power of the power assembly 16 is too low and reverse charge protection prevents the vehicle recharging the power assembly 16.

Further still, the flashlight 10 is provided with power supply protection technology designed to protect connected devices. This power supply protection technology is integrated into the second circuit board 61*b*. The power supply protection technology includes self-discharge protection. In accordance with this self-discharge protection, when the USB outlet port 68 and charging input port 66 are off, the outputs of the circuitry are set to off and the power assembly 16 can hold the power up to 1 year without recharging. Without this self-discharge protection, the power supply's standby mode would consume 38 mA current, and the power assembly 16 could only hold the power up to 10 days as peripheral circuitry would consumes power even if it is not in working status.

The power supply protection technology also provides the USB outlet port 68 with over current/over heat/short circuit protection, which is also integrated into the second printed circuit board 61*b*. When the USB outlet port 68 is over-current or short-circuited, the over current/over heat/short circuit protection circuitry quickly enters the protection mode to prevent overheat. When the over-current or short-circuit is corrected, the over current/over heat/short circuit protection circuitry returns to normal status and the USB outlet port 68 voltage will be output normally.

The power supply protection technology also provides over charge protection associated with the charging input port 66. The circuitry for the power supply protection technology is located on the second circuit board 61*b*. In accordance with the present invention, a two-stage over-charge protection function is provided. After plugging the charging adapter (not shown) in the charging input port 66, a charging circuit is formed to apply the voltage on the adapter to the battery 46 for charging. As the charging progresses, the first stage is initiated when any voltage is detected to rise to a predetermined level the charging circuit is disconnected, and charging stops. The second stage is activated when any voltage is detected by alternate circuitry of the over-charge protection resulting in the charging circuit being disconnected and the charging is stopped. As long as the first or second or two levels are engaged, the present over charge protection protects against overcharging.

The power supply protection technology also provides over discharge protection, which is integrated into the second printed circuit board 61*b*. After discharge has started, when the voltage at any point drops to a predetermined level, the discharge loop is disconnected, and the discharge is completed.

A pivotally mounted cover 74 is provided along the second end 50*b* of the power management module body member 50 to cover the charging input port 66, the USB outlet port 68, the jump start cable outlet port 71, and the LED charging indicator lights 70. The pivotally mounted cover 74 pivots via hinge 75. The cover 74 is positioned over the recess 72 along the second end 50*b* of the power management module body member 50 for movement between a first position covering the charging input port 66, the USB outlet port 68, the jump start cable outlet port 71, and the LED charging indicator lights 70 and a second position exposing the charging input port 66, the USB outlet port 68, the jump start cable outlet port 71, and the LED charging indicator lights 70.

The cover 74 is made from a ferromagnetic material and is retained in the first position covering the charging input port 66, the USB outlet port 68, the jump start cable outlet port 71, and the LED charging indicator lights 70 via mating magnets 76*a* and 76*b* position along the rim of the recess 72. A waterproof seal in the form of an O-ring 77 is positioned between the cover 74 and the rim of the recess 72 to further protect the charging input port 66, the USB outlet port 68, the jump start cable outlet port 71, and the LED charging indicator lights 70. The O-ring seal prevents water from entering the recess 72 and making contact with the charging input port 66, the USB outlet port 68, the jump start cable outlet port 71, and the LED charging indicator lights 70. The cover 74 is manually opened and closed. When closed, the compression of O-ring 77 between the interior wall 51 of the power management module body member 50 and the interior wall 71 of the cover 74, as well as the magnetic attraction between the magnets 76*a*, 76*b* and the cover 74 itself, prevent the cover 74 from accidentally being opened.

Further functionality is achieved through the inclusion of a magnet 80 along the exterior first surface 74*a* of the cover 74. In particular, the cover 74 includes an exterior first surface 74*a* and an interior second surface 74*b*. The interior second surface 74*b* faces the various ports and other functional elements when the cover 74 is in its first closed position. The magnetic 80 allows the flashlight 10 to be temporarily secured to magnetically active surfaces, for example the underside of an automobile hood. It should, however, be noted that the relative strengths of the magnet 80 and the magnets 76*a* and 76*b* must be balanced to ensure that the cover 74 remains closed until it is desired to open it. With this in mind, the strength of the magnet 80 is less than that of the combination of magnets 76*a* and 76*b*. This ensures that use of the magnet 80 does not inadvertently cause the cover 74 to release from magnets 76*a* and 76*b*.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A flashlight, comprising:

a flashlight head at a first end of the flashlight having a waterproof cavity retaining a LED light assembly;

a power assembly including a power management module body member with a pivotally mounted cover selectively covering a recess formed in a second end of the power management module body member, at least one of a USB outlet port, a charging input port, a jump start cable outlet port, and LED charging indicator lights are located within the recess, and an O-ring is positioned between the cover and the power management module body member in a manner providing waterproof protection for the at least one of the USB outlet port, the charging input port, the jump start cable outlet port, and the LED charging indicator lights when the cover is closed;

a central body member connected between the flashlight head and the power assembly to form a waterproof cavity retaining at least one rechargeable battery; and wherein the flashlight head includes an outer body member secured to a first end of the central body member and the LED light assembly is positioned within the outer body member, and the outer body member includes a front body member part separated from contact with a back body member part by a plastic heat insulating ring.

2. The flashlight according to claim 1, wherein the pivotally mounted cover uses magnets positioned on the power management module body member for securing the cover in a closed and sealed orientation.

3. The flashlight according to claim 2, wherein the cover includes an exterior surface having a magnet attached along the exterior surface of the cover.

4. The flashlight according to claim 3, wherein a strength of the magnet on the exterior surface of the cover is less than that of the magnets respectively positioned on the power management module body member.

5. The flashlight according to claim 1, wherein the flashlight head includes a crenelated strike bezel adapted to break a car window.

6. The flashlight according to claim 1, wherein the front body member part of the outer body member includes heat transfer fins that function to dissipate heat from the outer body member.

7. The flashlight according to claim 1, wherein the plastic heat insulating ring is a complete ring having a radial flange and first external threads on a first side of the radial flange and second external threads on a second opposite side of the radial flange, and the first external threads are secured to the front body member part and the second external threads are secured to the back body member part so as form the outer body member.

8. The flashlight according to claim 1, further including externally threaded colored lenses for selective attachment thereto.

9. The flashlight according to claim 1, wherein the power assembly also includes a power management module including at least one circuit board.

10. The flashlight according to claim 1, wherein the power management module includes a USB outlet port, a charging input port, a jump start cable outlet port, and LED charging indicator lights.

11. A high lumen output flashlight, comprising:

a flashlight head at a first end of the flashlight;

a power assembly at a second end of the flashlight; and a central body member positioned between the flashlight head and the power assembly;

the flashlight head includes an outer body member secured to a first end of the central body member and an LED light assembly is positioned within the outer body member, the outer body member includes a plastic heat insulating ring limiting the flow of heat from the outer body member to the central body member; and wherein the outer body member is of a three piece construction and includes a front body member part separated from contact with a back body member part by the plastic heat insulating ring.

12. The flashlight according to claim 11, wherein the plastic heat insulating ring is a complete ring having a radial flange and first external threads on a first side of the radial flange and second external threads on a second opposite side of the radial flange, and the first external threads are secured to the front body member part and the second external threads are secured to the back body member part so as form the outer body member.

13. The flashlight according to claim 12, wherein the outer body member includes an outer surface with heat transfer fins that functions to dissipate heat.

14. The flashlight according to claim 11, further including externally threaded colored lenses for selective attachment thereto.

15. The flashlight according to claim 11, wherein the power assembly also includes a power management module including at least one circuit board.

16. The flashlight according to claim 10, wherein the power management module includes a USB outlet port, a charging input port, a jump start cable outlet port, and LED charging indicator lights.

17. A high lumen output flashlight, comprising:

flashlight head at a first end of the flashlight;

a power assembly at a second end of the flashlight, the power assembly includes power management module body member with a pivotally mounted cover selectively covering a recess formed in a second end of the power management module body member, a USB outlet port, a charging input port, a jump start cable outlet port, and LED charging indicator lights are within the recess, and an O-ring is positioned between the pivotally mounted cover and the power management module body member in a manner providing waterproof or water resistant protection for the USB outlet port, the charging input port, the jump start cable outlet port, and the LED charging indicator lights when the pivotally mounted cover is closed, wherein the pivotally mounted cover uses mating magnets respectively positioned on the power management module body member and the cover for securing the cover in a closed orientation; and a central body member positioned between the flashlight head and the power assembly;

the flashlight head includes an outer body member secured to a first end of the central body member and an LED light assembly is positioned within the outer body member, the outer body member includes a plastic heat insulating ring limiting the flow of heat from the outer body member to the central body member, wherein the plastic heat insulating ring is a complete ring having a radial flange and first external threads on a first side of the radial flange and second external threads on a second opposite side of the radial flange, and the first external threads are secured to the front body member part and the second external threads are secured to the back body member part so as form the outer body member.

* * * * *